US005739836A

United States Patent [19]

Nishi

[11] Patent Number: 5,739,836

[45] Date of Patent: Apr. 14, 1998

[54] THERMAL PRINTHEAD ASSEMBLY

[75] Inventor: Koji Nishi, Kyoto, Japan

[73] Assignee: Rohm Co., Ltd., Kyoto, Japan

[21] Appl. No.: 822,452

[22] Filed: Mar. 21, 1997

[30] Foreign Application Priority Data

Mar. 22, 1996 [JP] Japan ..... 8-065838

[51] Int. Cl.[6] ..... B41J 2/335

[52] U.S. Cl. ..... 347/200

[58] Field of Search ..... 347/200, 209, 347/210

[56] References Cited

U.S. PATENT DOCUMENTS 4,963,886 10/1990 Fukuda .

5,335,002 8/1994 Nagahata et al. ..... 347/209

5,532,723 7/1996 Nagahata et al. ..... 347/209

*Primary Examiner*—Huan H. Tran

*Attorney, Agent, or Firm*—Merchant Gould Smith Edell Welter & Schmidt

[57] ABSTRACT

A thermal printhead assembly includes a metallic heat sink plate, a head circuit board mounted on an obverse surface of the heat sink plate, and a control circuit board electrically connected to the head circuit board for feeding control signals and power supply to the head circuit board. The head circuit board is formed with a heating resistor. A reverse surface of the heat sink plate is mounted on the control circuit board so that the heat sink plate is sandwiched between the head circuit board and the control circuit board.

10 Claims, 4 Drawing Sheets

THERMAL PRINTHEAD ASSEMBLY

BACKGROUND OF THE INVENTION

1. Field of the Invention

The present invention relates to a thermal printhead assembly which is incorporated in a printer or a facsimile machine for thermally printing images on a printing medium such as thermosensitive paper.

2. Description of the Related Art

As disclosed in U.S. Pat. No. 4,963,886, a typical line-type thermal printhead comprises a head circuit board supported on a heat sink plate, a linear heating resistor formed on the head circuit board, an array of drive ICs carried on the head circuit board to divisionally actuate the heating resistor for selective heat generation, and a connector board also supported on the heat sink plate in electrical connection with the head circuit board. The connector board is utilized for electrically connecting the head circuit board to a separate control circuit board through a flexible cable. The control circuit board carries various electric components for feeding control signals and power supply through the flexible cable.

In assembly, the heat sink plate of the thermal printhead together with the head circuit board is mounted on a suitable portion of the printer body (or facsimile machine body), whereas the control circuit board is mounted on another suitable portion of the printer body. Thus, at least two different portions of the printer body are required for separately mounting the heat sink plate and the control circuit board, thereby resulting in inefficient utilization of the printer space. As a result, the printer needs to be increased in size and weight.

Further, since a flexible cable needs to be used for electrically connecting the head circuit board and the control circuit board with additional intervention of the connector board, the number of required components as well as the time required for assembly increases correspondingly, resulting in an increased cost. Moreover, the flexible cable is susceptible to surge voltages, which results in noise generation.

SUMMARY OF THE INVENTION

It is, therefore, an object of the present invention to provide a thermal printhead assembly which can be incorporated conveniently in a space saving manner.

Another object of the present invention is to provide a thermal printhead assembly which eliminates noises resulting from the use of a flexible cable.

According to the present invention, there is provided a thermal printhead assembly comprising: a metallic heat sink plate having an obverse surface and a reverse surface; a head circuit board mounted on the obverse surface of the heat sink plate, the head circuit board being formed with a heating resistor; and a control circuit board electrically connected to the head circuit board for feeding control signals and power supply to the head circuit board; wherein the reverse surface of the heat sink plate is mounted on the control circuit board so that the heat sink plate is sandwiched between the head circuit board and the control circuit board.

With the structure described above, since the heat sink plate is mounted directly on the control circuit board, it is no longer necessary to mount the heat sink plate in a region separate from the control circuit board. Further, the head circuit board supported on the heat sink plate may be electrically connected to the control circuit board without using a flexible cable. Thus, it is possible to efficiently utilize the space of the printer or facsimile machine which incorporates the thermal printhead assembly while preventing noises which would be caused by the provision of a flexible cable.

According to a preferred embodiment of the present invention, the heat sink plate is mounted on the control circuit board at a mounting edge thereof. The heat sink plate may be elongate and have a marginal bent flange which is formed with an engaging slot, whereas the mounting edge of the control circuit board may be formed with an engaging projection engageable with the engaging slot of the bent flange. The marginal bent flange of the heat sink plate may extend over an entire length of the heat sink plate. Further, each end of the heat sink plate may be formed with a positioning slot, whereas the control circuit board may be provided with a positioning pin for engagement with the positioning slot of the heat sink plate.

The heat sink plate may be fixed on the control circuit board by screwing. Alternatively, the heat sink plate may be adhesively bonded to the control circuit board.

According to an advantageous embodiment, the head circuit board has a first longitudinal edge along which the heating resistor is formed, and a second longitudinal edge which partially projects beyond the heat sink plate and is formed with a first group of connection terminals at each end of the head circuit board. In this case, the control circuit board is formed with a second group of connection terminals in corresponding relation to the first group of connection terminals for electrical connection thereto.

Further, each end of the heat sink plate may be preferably formed with a corner cutout which partially overlaps the second longitudinal edge of the head circuit board. In this case, the second group of connection terminals may advantageously be located at the corner cutout of the heat sink plate for space saving purposes.

Moreover, the first group of connection terminals may be connected to the second group of connection terminals through a clip-type terminal lead respectively although the electrical connection may be otherwise established.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
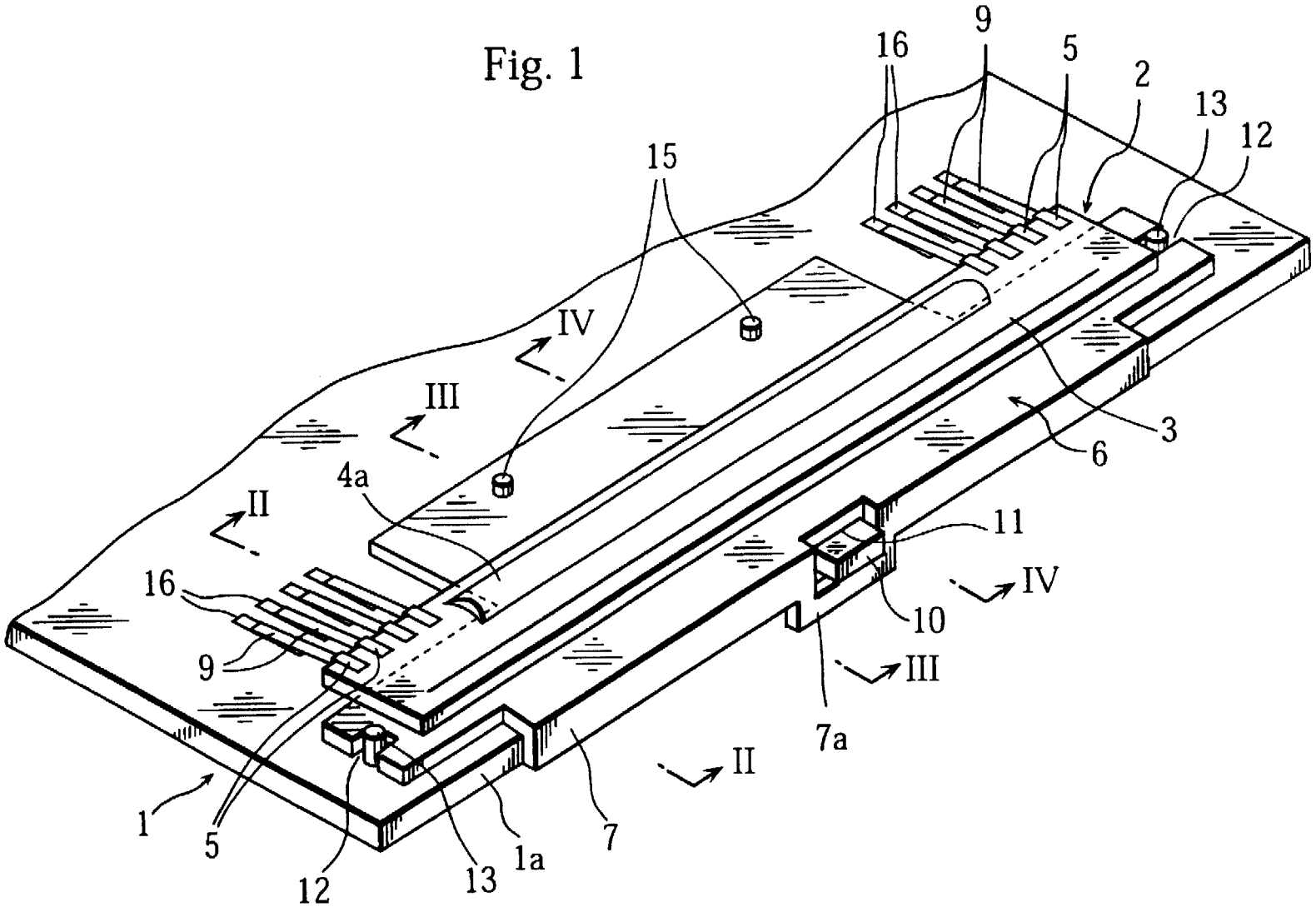
FIG. 1 is a perspective view showing a thermal printhead assembly embodying the present invention.
Figure 2:
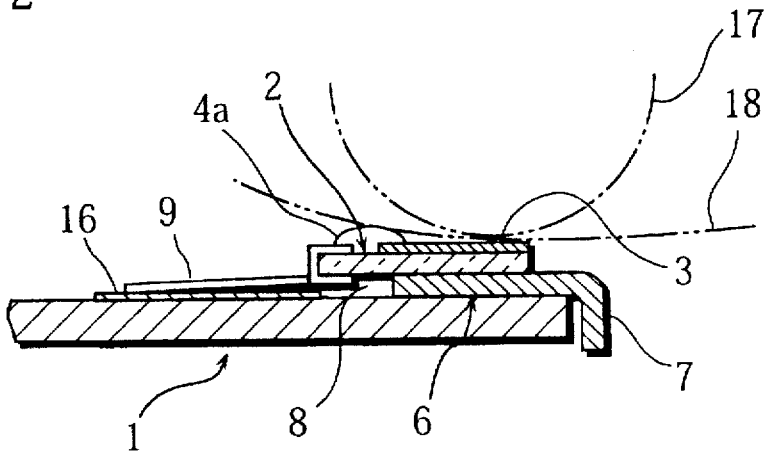
FIG. 2 is a fragmentary sectional view taken along lines II—II in FIG. 1.
Figure 3:
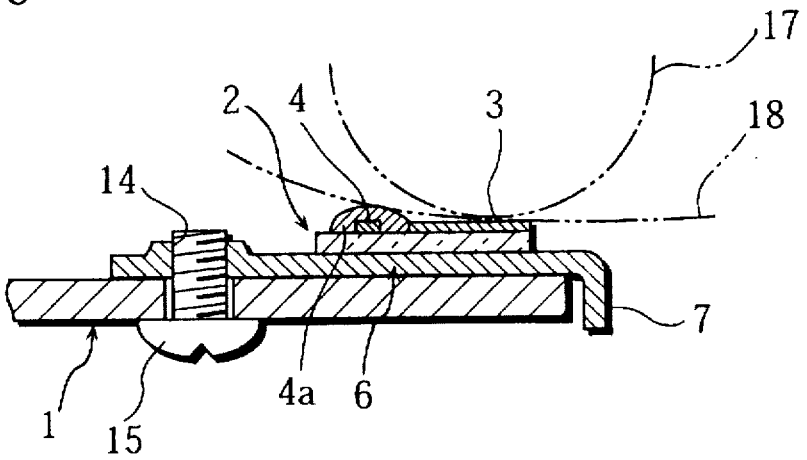
FIG. 3 is a fragmentary sectional view taken along lines III—III in FIG. 1.
Figure 4:
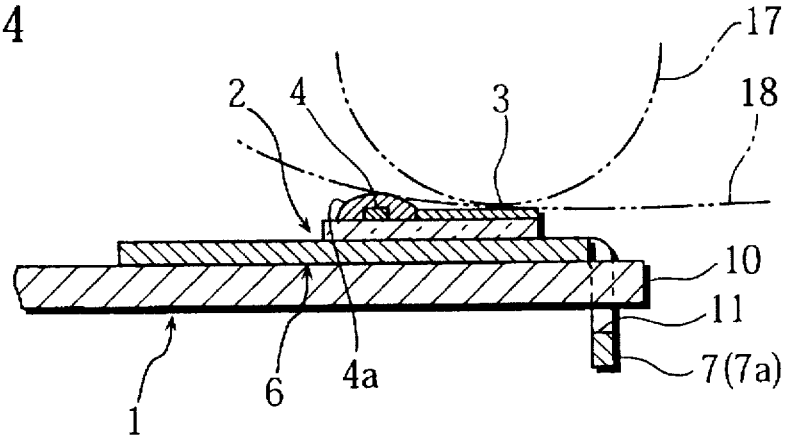
FIG. 4 is a fragmentary sectional view taken along lines IV—IV in FIG. 1.

Referring first to FIGS. 1 to 5 of the accompanying drawings, there is illustrated a thermal printhead assembly embodying the present invention. The illustrated printhead assembly, mainly comprises a control circuit board 1, a head circuit board 2 and a heat sink plate 6.

The control circuit board 1, which is rectangular or square in shape, is made of an insulating material such as glass-fiber-reinforced epoxy resin or ceramic. The control circuit board 1 carries circuit elements (not shown) for feeding various control signals and power supply to the head circuit board 2. Further, the control circuit board 1 also carries drive elements and control elements for operating the components of the printer or facsimile machine other than the printhead.

The head circuit board 2, which is in the form of a strip, is also made of an insulating material such as glass-fiber-reinforced epoxy resin or alumina ceramic. The head circuit board 2 is formed with a linear heating resistor 3 extending along a first longitudinal edge 2*a* (see FIG. 5) of the head circuit board 2. The head circuit board 2 also carries an array of drive ICs 4 (see FIGS. 3 and 4) extending along a second longitudinal edge 2*b* of the head circuit board 2 and enclosed in a protective resin coating 4*a*. Further, each end of the head circuit board 2 is formed, at the second longitudinal edge 2*b*, with a first group of connection terminals 5 which include signal input terminals, a power supply terminal, and a grounding terminal. Though not illustrated, the head circuit board 2 is additionally formed with a sophisticated wiring conductor pattern for electrically connecting the drive ICs 4 to the connection terminals 5 and to the heating resistor 3.

The heat sink plate 6 is made of a metal such as aluminum which is high in thermal conductivity for efficiently dissipating the heat generated by the heating resistor 3 of the head circuit board 2. The heat sink plate 6 has an obverse surface in intimate contact with the head circuit board 2, whereas the reverse surface of the heat sink plate 6 is held in intimate contact with the control circuit board 1. Thus, the heat sink plate 6 is sandwiched between the control circuit board 1 and the head circuit board 2. The head circuit board 2 may be fixed on the obverse surface of the heat sink plate 6 by adhesive bonding for example.

The heat sink plate 6 has an integral bent flange 7 for engagement with a mounting edge 1*a* of the control circuit board 1 which is close to the first longitudinal edge 2*a* of the head circuit board 2 in parallel thereto. This flange 7 mechanically reinforces the heat sink plate 6 against warping, so that the heat sink plate 6 may be rendered relatively thin to realize a weight reduction while also realizing a material savings.

The bent flange 7 has a central enlarged portion 7*a* formed with an engaging slot 11, whereas the mounting edge 1*a* of the control circuit board 1 has an engaging projection 10 inserted in the engaging slot 11 of the bent flange 7. At the time of assembly, the combination of the engaging projection 10 and the engaging slot 11 is effective for properly positioning the heat sink plate 6 relative to the mounting edge 1*a* of the control circuit board 1 while preventing the heat sink plate 6 from displacing away from the control circuit board.

Each end of the heat sink plate 6 is formed with a positioning slot 12, whereas the control circuit board 1 carries a positioning pin 13 for engagement with the positioning slot 12 of the heat sink plate 6. At the time of assembly, the combination of the positioning slot 12 and the positioning pin 13 is effective for preventing the heat sink plate 6 from positionally deviating relative to the control circuit board 1 in longitudinal and lateral directions.

The heat sink plate 6 is also formed with threaded bores 14 (FIG. 5) for engagement with screws 15. Thus, the heat sink plate 6 is fixed in place on the control circuit board 1 by engaging the screws 15 into the threaded bores 14.

Each end of the heat sink plate 6 is formed with a corner cutout 8 for partially overlapping with a corresponding end of the head circuit board 2, so that the first group of connection terminals 5 of the head circuit board 2 are located above the corner cutout 8. Further, the control circuit board 1 is formed, at a portion corresponding to each corner cutout 8 of the heat sink plate 6, with a second group of connection terminals 16 which include signal input terminals, a power supply terminal, and a grounding terminal in corresponding relation to the first group of connection terminals 5.

Each of the first group of connection terminals 5 is electrically connected to a corresponding one of the second group of connection terminals 16 through a clip-type terminal lead 9. This terminal lead 9 is made of a metal and has a clip end portion for engagement with the second longitudinal edge 2*b* of the head circuit board 2 in electrical contact with the corresponding first group connection terminal 5. Further, the clip-type terminal lead 9 also has an inclined stem portion which is bonded to the corresponding second group connection terminal 16 by soldering or by applying an electrically conductive adhesive paste.

In operation of the thermal printhead assembly, a platen 17 (see FIGS. 2–4) holds a printing medium 18 such as thermosensitive paper in contact with the heating resistor 3. In this condition, the heating resistor 3 is actuated divisionally and selectively by the drive ICs 4 for performing intended printing onto the printing medium 18.

According to the structure of the thermal printhead assembly described above, since the heat sink plate 6 supporting the head circuit board 2 is mounted directly on the control circuit board 1 at the mounting edge 1*a* thereof, there is no need to provide a separate space for mounting the heat sink plate 6 together with the head circuit board 2. In other words, a portion of the printer or facsimile machine used for mounting the control circuit board 1 can be also utilized for mounting the heat sink plate 6 together with the head circuit board 2.

Further, since the head circuit board 2 is electrically connected to the control circuit board 1 through the clip-type terminal leads 9, the use of a flexible cable is no longer necessary. Thus, noises which would result due to the provision of a flexible cable can be prevented.

Moreover, since the second group of connection terminals 16 and the clip-type terminal leads 9 are located at the corner cutouts 8 of the heat sink plate 6, there is no need to provide an excess space or area for arranging these components. Thus, the surface area of the control circuit board 1 can be efficiently used, and the size of the control circuit board 1 need not be unduly increased due to the direct mounting of the heat sink plate 6.

Figure 5:
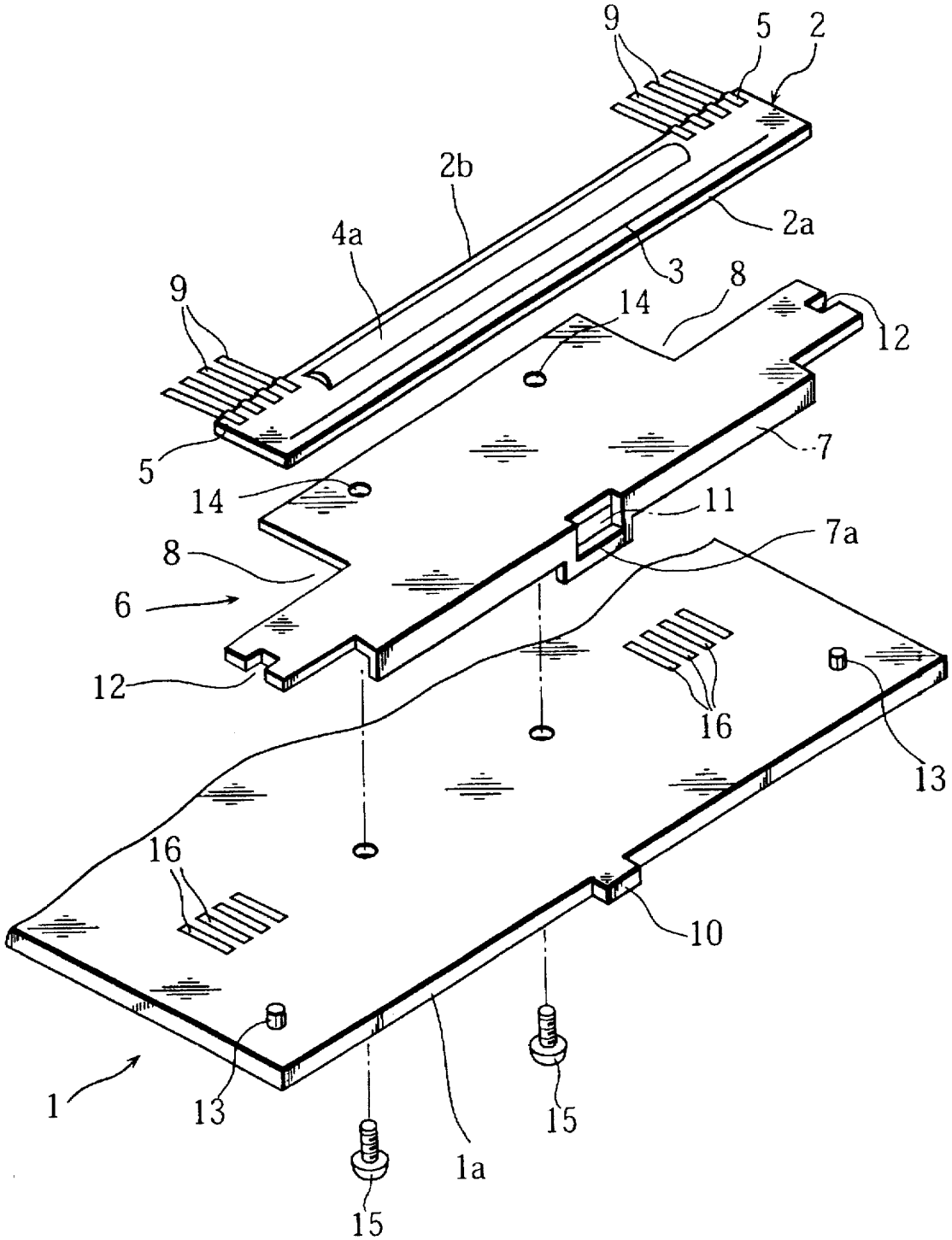
FIG. 5 is an exploded perspective view showing the same printhead assembly.
Figure 6:
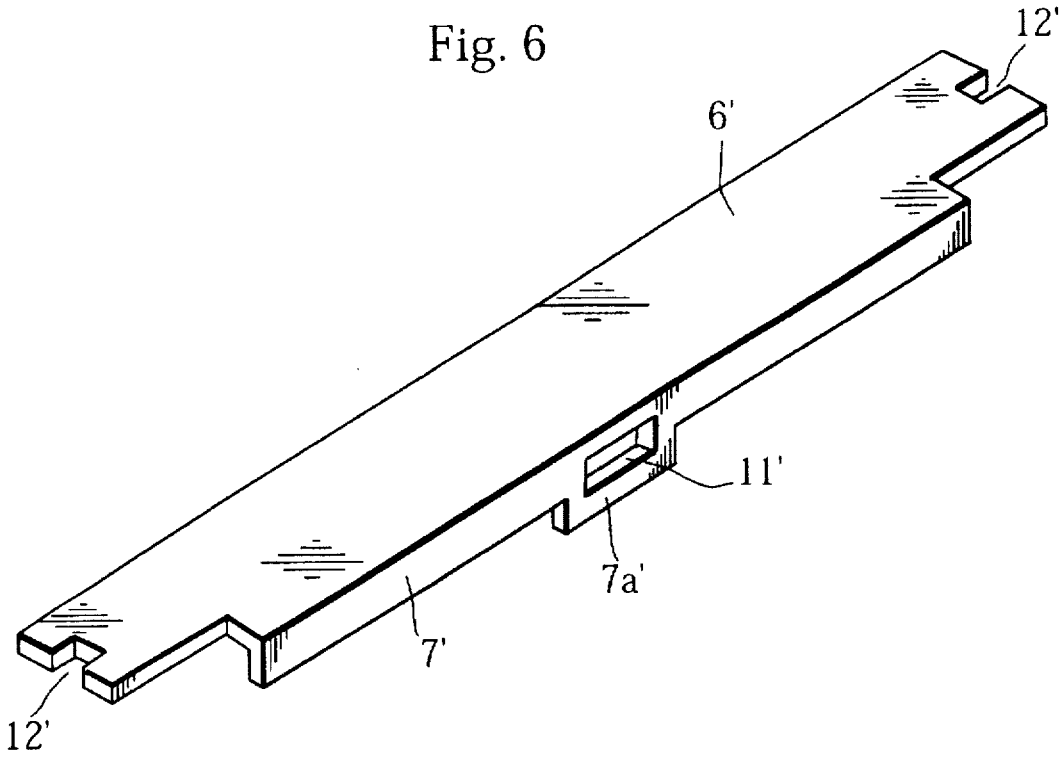
FIG. 6 is a perspective view showing a modified heat sink plate.

FIG. 6 shows a modified heat sink plate 6' which may replace the heat sink plate 6 illustrated in FIGS. 1 through 5. Like the foregoing embodiment, the modified heat sink plate 6' has an integral bent flange 7' with an enlarged central portion 7*a'* which is formed with an engaging slot 11'. Further, each end of the heat sink plate 6' is formed with a positioning slot 12'.

However, unlike the foregoing embodiment, the modified heat sink plate 6' has no corner cutout corresponding to the corner cutouts 8 shown in FIG. 5. Instead, the width (maximum width) of the modified heat sink plate 6' is reduced in comparison with the heat sink plate 6 shown in FIGS. 1–5. Thus, when the modified heat sink plate 6' is used in place of the heat sink plate 6 shown in FIGS. 1–5, the second longitudinal edge 2b of the head circuit board 2 projects entirely beyond the modified heat sink plate 6'.

Figure 7:
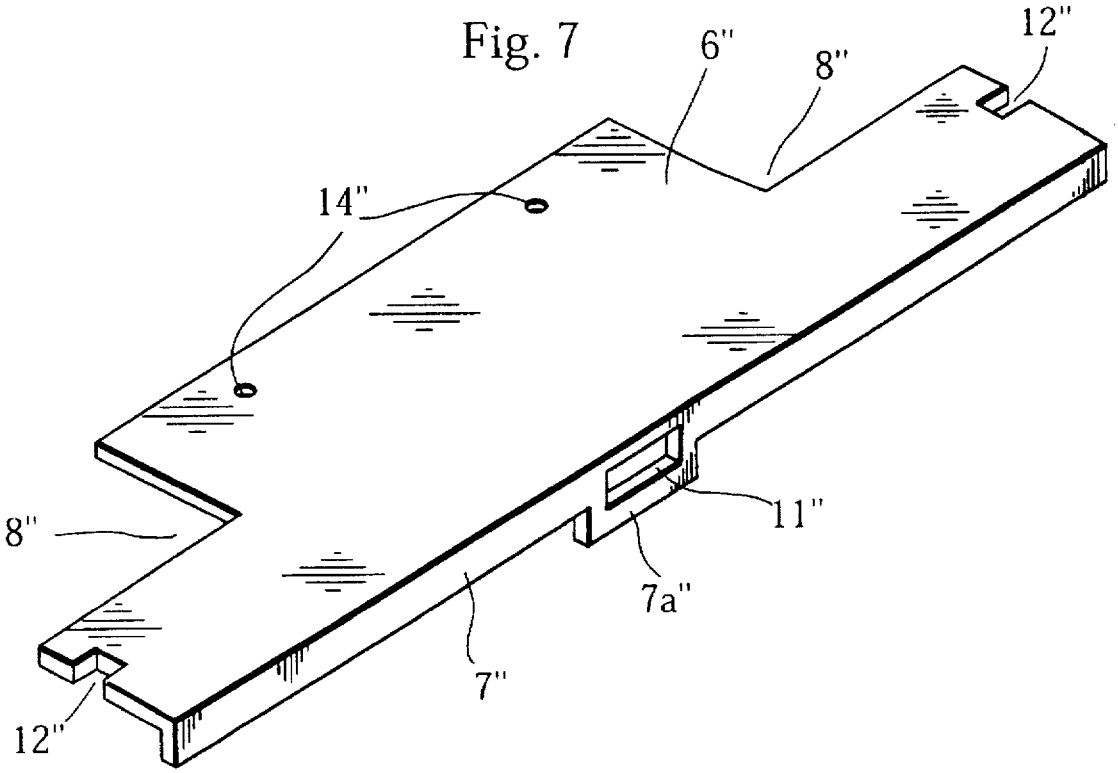
FIG. 7 is a perspective view showing another modified heat sink plate.

FIG. 7 shows another modified heat sink plate 6" which may also replace the heat sink plate 6 illustrated in FIGS. 1 through 5. This modified heat sink plate 6" is similar to the heat sink plate 6 shown in FIGS. 1–5, so that the corresponding parts are designated by the same reference numerals with a double prime (").However, the bent flange portion 7" is elongated to extend over the entire length of the heat sink plate 6".

The present invention being thus described, it is obvious that the same may be varied in many other ways. For instance, instead of providing the clip-type terminal leads 9, a socket-type connector may be mounted to the second longitudinal edge 2b of the head circuit board 2 at each end thereof, and a plurality of pins projecting upright from the control circuit board 1 are inserted into the socket-type connector for establishing electrical connection between the head circuit board 2 and the control circuit board. Such variations are not to be regarded as a departure from the spirit and scope of the invention, and all such variations as would be obvious to those skilled in the art are intended to be included within the scope of the following claims.

I claim:

1. A thermal printhead assembly comprising:

a metallic heat sink plate having an obverse surface and a reverse surface;

a head circuit board mounted on the obverse surface of the heat sink plate, the head circuit board being formed with a heating resistor; and a control circuit board electrically connected to the head circuit board for feeding control signals and power supply to the head circuit board;

wherein the reverse surface of the heat sink plate is mounted on the control circuit board so that the heat sink plate is sandwiched between the head circuit board and the control circuit board.

2. The thermal printhead assembly according to claim 1, wherein the heat sink plate is mounted on the control circuit board at a mounting edge thereof.

3. The thermal printhead assembly according to claim 2, wherein the heat sink plate is elongate and has a marginal bent flange which is formed with an engaging slot, the mounting edge of the control circuit board being formed with an engaging projection engageable with the engaging slot of the bent flange.

4. The thermal printhead assembly according to claim 3, wherein each end of the heat sink plate is formed with a positioning slot, the control circuit board being provided with a positioning pin for engagement with the positioning slot of the heat sink plate.

5. The thermal printhead assembly according to claim 1, wherein the heat sink plate is fixed on the control circuit board by screwing.

6. The thermal printhead assembly according to claim 1, wherein the head circuit board partially projects beyond the heat sink plate for electrical connection to the control circuit board.

7. The thermal printhead assembly according to claim 6, wherein the head circuit board has a first longitudinal edge along which the heating resistor is formed, the head circuit board also having a second longitudinal edge which partially projects beyond the heat sink plate, the second longitudinal edge of the head circuit board being formed with a first group of connection terminals at each end of the head circuit board, the control circuit board being formed with a second group of connection terminals in corresponding relation to the first group of connection terminals for electrical connection thereto.

8. The thermal printhead assembly according to claim 7, wherein each end of the heat sink plate is formed with a corner cutout which partially overlaps the second longitudinal edge of the head circuit board, the second group of connection terminals being located at the corner cutout of the heat sink plate.

9. The thermal printhead assembly according to claim 7, wherein the first group of connection terminals is connected to the second group of connection terminals through a clip-type terminal lead, respectively.

10. The thermal printhead assembly according to claim 3, wherein the marginal bent flange of the heat sink plate extends over an entire length of the heat sink plate.

* * * * *